US009086046B2

(12) United States Patent
Kajita et al.

(10) Patent No.: US 9,086,046 B2
(45) Date of Patent: Jul. 21, 2015

(54) IGNITION APPARATUS FOR AN INTERNAL COMBUSTION ENGINE

(71) Applicant: DENSO CORPORATION, Kariya, Aichi-pref. (JP)

(72) Inventors: Yuji Kajita, Chita-gun (JP); Masamichi Shibata, Toyota (JP); Yasuomi Imanaka, Obu (JP); Atsuya Mizutani, Nagoya (JP); Tsutomu Oosuka, Gamagori (JP)

(73) Assignee: DENSO CORPORATION, Kariya (JP)

( * ) Notice: Subject to any disclaimer, the term of this patent is extended or adjusted under 35 U.S.C. 154(b) by 480 days.

(21) Appl. No.: 13/648,483

(22) Filed: Oct. 10, 2012

(65) Prior Publication Data

US 2013/0192570 A1 Aug. 1, 2013

(30) Foreign Application Priority Data

Oct. 11, 2011 (JP) ..... 2011-223859
Sep. 12, 2012 (JP) ..... 2012-200852

(51) Int. Cl.

| | |
|---|---|
| ***F02P 3/04*** | (2006.01) |
| ***F02P 13/00*** | (2006.01) |
| ***F02P 3/08*** | (2006.01) |
| ***F02P 9/00*** | (2006.01) |
| *F02P 15/00* | (2006.01) |
| *F02P 3/05* | (2006.01) |

(52) U.S. Cl.

CPC . *F02P 13/00* (2013.01); *F02P 3/04* (2013.01); *F02P 3/0838* (2013.01); *F02P 3/0884* (2013.01); *F02P 9/00* (2013.01); *F02P 15/00* (2013.01); *F02P 3/051* (2013.01); *F02P 3/053* (2013.01)

(58) Field of Classification Search

CPC ..... F02P 3/04; F02P 13/00; F02P 3/0838; F02P 3/0884; F02P 3/051; F02P 3/053; F02P 3/0435
USPC ..... 123/596, 644, 650
See application file for complete search history.

(56) References Cited

U.S. PATENT DOCUMENTS 5,424,647 A * 6/1995 Ohsawa et al. ..... 324/378
6,116,212 A * 9/2000 Dykstra ..... 123/335

(Continued)

FOREIGN PATENT DOCUMENTS

JP 5-312094 11/1993
JP 2003-345951 12/2000

(Continued)

OTHER PUBLICATIONS

Office Action (3 pages) dated May 26, 2015, issued in corresponding Japanese Application No. 2012-200852 and English translation (3 pages).

*Primary Examiner* — Hieu T Vo
(74) *Attorney, Agent, or Firm* — Nixon & Vanderhye PC

(57) ABSTRACT

An ignition apparatus is provided with a Zener diode as a limiter device, which limits a primary voltage of an ignition coil to be less than a Zener voltage, and a switching circuit, which prohibits a limiter function of the Zener diode at a start of discharge and switches the limiter device to perform the limiter function for a predetermined time period following the start of discharge. A secondary voltage is limited to be more than a secondary limit value. Even when blowout arises in discharging, re-discharging is avoided from arising immediately after the blowout and exhaustion of a spark plug caused by repetition of discharging is avoided.

10 Claims, 6 Drawing Sheets

(56) References Cited

U.S. PATENT DOCUMENTS

| | | | | |
|---|---|---|---|---|
| 6,595,194 | B1 * | 7/2003 | Ito et al. | 123/644 |
| 2008/0257324 | A1 * | 10/2008 | French | 701/102 |

FOREIGN PATENT DOCUMENTS

| | | | |
|---|---|---|---|
| JP | P2000-345951 | A | 12/2000 |
| JP | 2001-193622 | | 7/2001 |

* cited by examiner

IGNITION APPARATUS FOR AN INTERNAL COMBUSTION ENGINE

CROSS REFERENCE TO RELATED APPLICATION

This application is based on and incorporates herein by reference Japanese patent applications No. 2011-223859 filed on Oct. 11, 2011 and No. 2012-200852 filed on Sep. 12, 2012.

TECHNICAL FIELD

The present disclosure relates to an ignition apparatus for an internal combustion engine including an ignition coil, which generates a secondary voltage supplied to a spark plug.

BACKGROUND ART

In a conventional ignition apparatus, as shown in FIG. 8, a spark plug 30 mounted on a spark-ignited engine has a center electrode 31 and a ground electrode 32. Electric discharge is generated between the electrodes 31 and 32 normally as indicated by SP1, which takes the shortest path. Recently however turbulent flow such as tumble flow or swirl flow is generated in a combustion chamber of a lean-burn engine to improve combustion. In such an engine, which generates the turbulent flow, air flows as an air stream F at high speeds within a combustion chamber. The air stream F changes the discharge in the form of SP1 to a discharge in a form of SP2, which has a longer discharge path.

When the air flows at high speeds, the discharge is blown out or extinguished once and immediately thereafter the discharge restarts in the shortest distance (path indicated as SP1) between the electrodes 31 and 32. Even when the discharge is generated again, it may be blown out again by the air stream F. Thus repetition of the blowout and the discharge arises and causes exhaustion of the electrodes 31 and 32 (plug exhaustion) much faster than usual.

For example, the blowout is not caused in a capacitive discharge period (short period near t3 in FIG. 2) because the secondary current is sufficiently large. The blowout arises in an inductive discharge period (period t3 to t4 in FIG. 2), in which the secondary current gradually decreases.

Some ignition apparatuses disclosed in JP 2001-193622A and JP 2000-345951A, for example, counter the plug exhaustion caused by the repetition of discharges as follows. Specifically, a primary current is supplied to terminate forcefully the discharge at an end of a discharge period from a start of the discharge. The discharge period is set in accordance with operating conditions of the internal combustion engine. Thus, a period, in which the blowout is likely to arise, can be eliminated in the inductive discharge period t3 to t4, in which the secondary current is small. As a result, the repetition of the discharge can be avoided and the exhaustion of plugs can be countered.

However, the speed of air stream F, which causes the blowout, differs due to variation in the angle of mounting of the spark plug on the engine. The air stream condition in the cylinder is not stable and varies from time to time. It is therefore very difficult to determine whether the speed of air stream will cause the blowout in each engine. It is therefore very difficult in the conventional ignition apparatuses to set a discharge period to the most optimum value in correspondence to the air stream condition.

For this reason, if the discharge period is set to be excessively short in spite of low possibility of blowout for example, misfire may be caused due to insufficiency of the discharge period. This misfire becomes critical in an operating condition, in which ignitability is poor. If the discharge period is set to be excessively long in spite of high possibility of blowout, it becomes impossible to avoid the repetition of discharge.

SUMMARY

It is therefore an object to provide an ignition apparatus for an internal combustion engine, which suppresses plug exhaustion while avoiding repetition of discharging and avoids misfire caused by insufficiency of a discharge period.

According to one aspect, an ignition apparatus for an internal combustion engine includes a spark plug, an ignition coil, a limiter device and a switching device. The ignition coil has a primary coil and a secondary coil for supplying the spark plug with a secondary voltage generated by the secondary coil for a discharge operation of the spark plug in correspondence to a change in a primary voltage of the primary coil. The limiter device limits, as a limiter function, the primary voltage to be equal to or less than a predetermined value in absolute value. The switching device prohibits the limiter function of the limiter device at a start of discharge of the spark plug and switches the limiter device to perform the limiter function for a predetermined time period after the start of discharge operation of the spark plug.

BRIEF DESCRIPTION OF THE DRAWINGS

The above and other objects, features and advantages of an ignition apparatus will become more apparent from the following detailed description made with reference to the accompanying drawings. In the drawings.

EMBODIMENT

Figure 1:
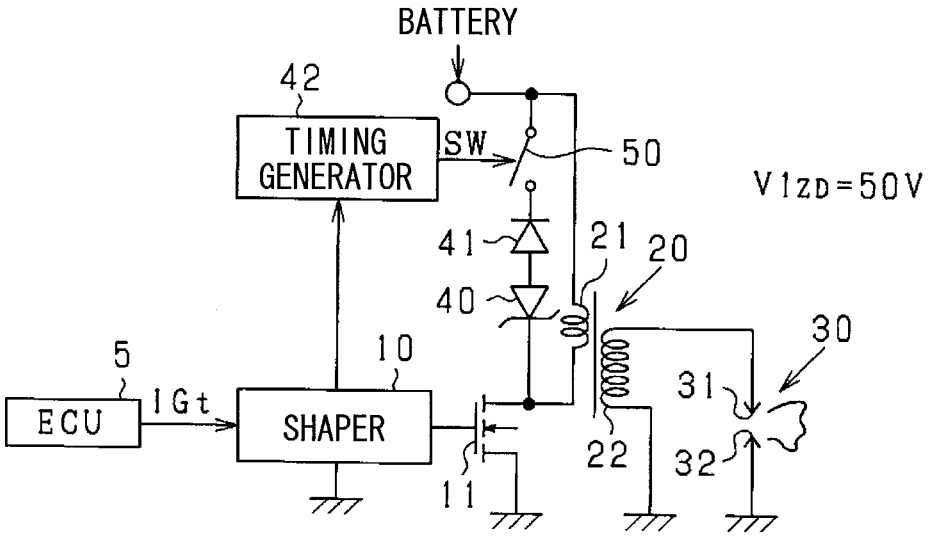
FIG. 1 is a schematic diagram of an ignition apparatus for an internal combustion engine according to a first embodiment.

An ignition apparatus for an internal combustion engine will be described below with reference to embodiments shown in the drawings. In the following embodiments, same or equivalent parts are designated by same reference numerals in the drawings and description of such parts will be simplified.

First Embodiment

An ignition apparatus according to a first embodiment is provided in an ignition system of an internal combustion engine, which is a spark-ignited engine mounted on a vehicle.

As shown in FIG. 1, the ignition apparatus includes an electronic control unit (ECU) 5, in which a microcomputer is provided to acquire operating condition information, which indicates operating conditions of the engine such as an engine rotation speed, an accelerator operation amount, an intake air temperature and an engine coolant temperature, and calculates an optimum ignition timing based on the operating condition information. The microcomputer generates an ignition signal IGt in correspondence to the calculated ignition timing and outputs the ignition signal IGt to a waveform shaper circuit 10.

The waveform shaper circuit 10 outputs a drive signal IG, which turns on and off a power device 11 provided as a switching device, in response to the ignition signal IGt outputted from the ECU 5. Specifically, the power device 11 is connected in series with a primary coil 21 of an ignition coil 20 and turned on and off in response to the ignition signal IGt to cause an initial discharge at each ignition timing.

The ignition coil 20 is provided for each cylinder has a secondary coil 22 in addition to the primary coil 21. The primary coil 21 is connected at one end thereof to a high potential (+14V) side of a battery through a power circuit (not shown) and at the other end thereof to a ground through the power device 11. A gate of the power device 11 is connected to the waveform shaper circuit 10 so that the power device 11 is controlled to turn on and off by the drive signal IG outputted from the waveform shaper circuit 10.

The secondary coil 22 is connected at one end thereof to a spark plug 30 and grounded at the other end thereof. Currents, which flow in the primary coil 21 and the secondary coil 22, are referred to as a primary current I1 and a secondary current I2, respectively. Voltages of the primary coil 21 and the secondary coil 22 are referred to as a primary voltage V1 and a secondary voltage V2, respectively.

The spark plug 30 has a center electrode 31 connected to the secondary coil 22 and a ground electrode 32 connected (grounded) to the engine. The ignition apparatus is configured as a circuit, which supplies a current from the ground side to the secondary coil 22 to cause a discharge (negative discharge), by setting the voltage V2 to be lower than the ground voltage.

A Zener diode 40 is electrically connected as a limiter device to the primary coil 21 in parallel. Specifically, a cathode side of the Zener diode 40 is connected to the ground side (low potential side) of the primary coil 21. An anode side of the Zener diode 40 is connected to a high potential side of the primary coil 21 through a diode 41 and a switch circuit 50. As long as the switch circuit 50 is turned on, the Zener diode 40 is turned on when a ground side potential of the primary voltage V1 reaches a Zener voltage (predetermined breakdown voltage) V1ZD. The primary voltage V1 is thus limited to be equal to or lower than the Zener voltage V1ZD. That is, the Zener diode 40 forms a constant voltage circuit, which limits the primary voltage V1 to be equal to or lower than the Zener voltage V1ZD.

An anode side of the diode 41 is connected to the anode side of the Zener diode 40. That is, the diode 41 is connected in such a direction that the current flowing from the battery is normally prevented from bypassing the primary coil 21 and flowing to the ground through the Zener diode 40.

The switch circuit 50 is controlled to turn on and off in response to a timing signal SW outputted from a timing generator circuit 42. The timing generator circuit 42 outputs a timing signal SW based on either the ignition signal IGt or the drive signal IG. That is, the switch circuit 50 (switching device) switches over, in response to the timing signal SW, functional states of limiting the primary voltage V1 by the Zener diode 40 (limiter function) and inhibiting the limiter function.

Figure 2:
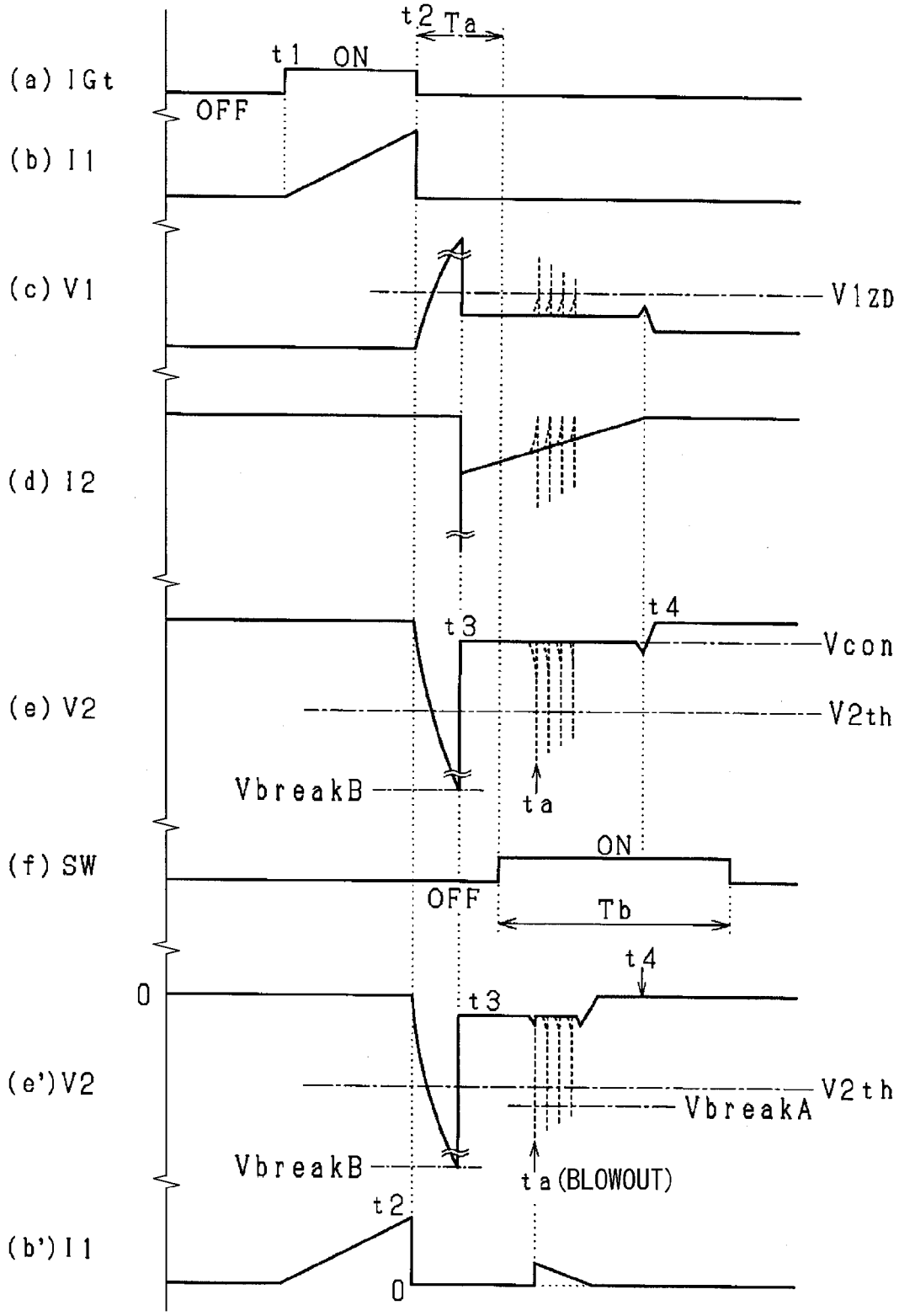
FIG. 2 is a time chart showing an operation of the ignition apparatus according to the first embodiment.
Figure 8:
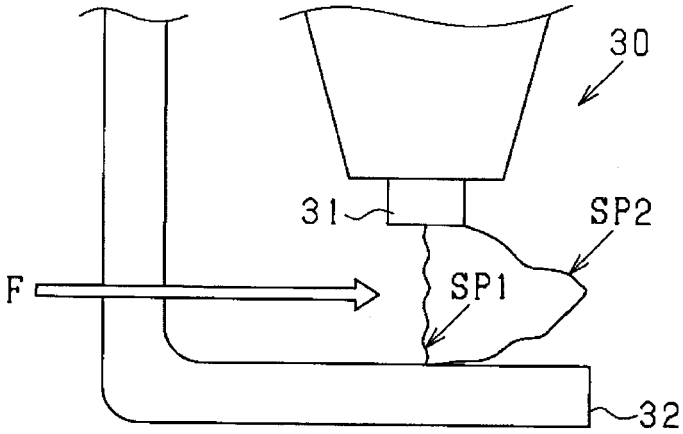
FIG. 8 PRIOR ART
FIG. 8 is a schematic view showing repetition of discharging in a conventional spark plug.

The operation of the ignition apparatus will be described with reference to FIG. 2, which shows one spark ignition event in each cylinder of the engine. In FIG. 2, solid lines in (a) to (f) in a time chart show changes in the ignition signal IGt, the primary current I1, the primary voltage V1, the secondary current I2, the secondary voltage V2 and the timing signal SW in a case that the discharge is not blown out. Solid lines in (e') and (b') in the time chart of FIG. 2 show changes in the secondary voltage V2 and the primary current I1 in a case that the discharge is blown out by, for example, air stream F (FIG. 8). Dotted lines in FIG. 2 show changes in a case that repetition of blowout and discharge arises in an ignition apparatus, in which the Zener diode 40 and the switch circuit 50 are not provided.

First, the operation indicated by the solid lines in (a) to (f) will be described.

Assuming that the ignition signal IGt is changed from OFF to ON at time t1 in FIG. 2, the power device 11 is turned on. As a result, the current supply to the primary coil 21 is started so that the primary coil 21 starts charging and the primary current I1 gradually increases.

When the ignition signal IGt is changed from ON to OFF at time t2, the power device 11 is turned off. As a result, the current supply to the primary coil 21 is shut off so that the primary voltage V1 increases and the secondary voltage V2 decreases (absolute value of V2 increases). A discharge starts between the electrodes 31 and 32 of the spark plug 30, and the secondary current I2 is outputted from the secondary coil 22 to the spark plug 30. Magnitudes of the primary voltage V1, the secondary current I2 and the secondary voltage V2 attain respective peak values in a capacitive discharge period (short period near t3). The magnitudes gradually decrease in a subsequent inductive discharge period from time t3 to time t4 and becomes zero at time t4.

The timing signal SW is changed from OFF to ON at time, which is after an elapse of a predetermined time period Ta from time of a command of power supply control for the primary coil 21 to start discharging of the spark plug 30 (that is, from time t2, at which the ignition signal IGt is changed to OFF). As a result, until the predetermined time period Ta elapses after the start of discharging of the spark plug 30, the limiter function by the Zener diode 40 is prohibited and the limiter function is started after the elapse of the predetermined time period Ta. The predetermined time period Ta is set to a fixed value and counted by a timer or a counter.

The timing signal SW is changed to OFF after an elapse of a predetermined time period Tb from the change of the timing signal to ON. As a result, the limiter function of the Zener diode 40 is continued until the predetermined time period Tb elapses after the limiter function is started.

The operation indicated by the dotted lines in (a) to (f) will be described next.

In a case that the Zener diode 40 and the circuit 50 are not provided, the secondary voltage V2 increases (absolute value of V2 decreases) when the blowout arises at time ta. If discharge energy remains in the coil 20 at this moment, the discharge is generated in the shortest distance path (path indicated as SP1) between the electrodes 31 and 32. Since the ionization still remains between the electrodes 31 and 32 at time of immediately after the blowout, the secondary voltage V2 (redischarge-required voltage VbreakA) required for the discharge is lower than the secondary voltage V2 (discharge-required voltage VbreakB) required at time of starting the discharge first at time t3 (capacitive discharge start time).

By thus repeating the blowout and the discharge, the amount of discharge energy of the coil 20 and remaining in the coil 20 decreases. When the secondary voltage V2 immediately after the blowout cannot rise to the redischarge-required voltage VbreakA, the redischarge ends at that time.

When the secondary voltage V2 rises to exceed the redischarge-required voltage VbreakA and the discharge arises again, the primary coil 21 generates a voltage, which is proportional to a ratio of turns of the coils 21 and 22 in the ignition coil 20, to increase the primary voltage V1. It is therefore possible to limit an increase of the secondary voltage V2 by limiting the voltage V1 generated in the primary coil 21. That is, it is possible to avoid the discharge by limiting the increase of the primary voltage V1 so that the rise of the secondary voltage V2 is limited to be equal to or lower than the redischarge-required voltage VbreakA.

For this reason, the primary voltage V1 is limited to rise to be equal to or lower than the Zener voltage V1ZD by turning on the switch circuit 50 in the inductive discharge period t3 to t4, in which the blowout is likely to occur. The Zener voltage V1ZD is set to a value so that the secondary voltage V2 is limited to be or lower than a predetermined value (secondary limit value V2*th*).

For example, in a case that the secondary limit value V2*th* is set to be sufficiently lower than the redischarge-required voltage VbreakA and higher than a discharge maintaining voltage (4 kV), the Zener voltage V1ZD is set to 50V with the ratio of windings between the primary coil 21 and the secondary coil 22 being 80 thereby to avoid the redischarge occurring immediately after the blowout. Thus, it is possible to limit the secondary voltage V2 to satisfy V2≤V2*th*. The secondary limit value V2*th* is however set to be smaller (absolute value is higher) than the secondary voltage (maintaining voltage Vcon in (e) of FIG. 2) required to maintain the inductive discharge. That is, the Zener voltage V1ZD is set so that the secondary voltage V2 is in a range defined by the maintaining voltage Vcon and the predetermined secondary limit voltage value V2*th*.

The operation indicated by solid lines in (e') and (b') will be described next.

According to the ignition apparatus, in which the voltage V1ZD is set as described above, the primary current I1 is generated as a result of limitation of the primary voltage V1 by the remaining discharge energy of the ignition coil 20 immediately after the blowout arises at time ta and the secondary voltage V2 rises (absolute value of V2 falls). The primary current I1 flows to the primary coil 21 through the Zener diode 40 as shown in (b'). That is, the remaining discharge energy of the ignition coil 20 is absorbed without increasing the secondary voltage V2. As the remaining discharge energy decreases, the primary current I1 also falls.

In summary, when the blowout does not arise, the discharge is continued in the normal manner (refer to (e)) during the inductive discharge period t3 to t4 corresponding to the inductive discharge period t3 to t4 corresponding to the charge period t1 to t2, which is commanded by the ignition signal IGt. When the blowout arises, the inductive discharge period is interrupted at time ta and the redischarge immediately after the blowout is avoided as shown by (e').

The detailed circuit configuration of the switch circuit 50 will be described next with reference to FIG. 3.

The switch circuit 50 controls a base voltage of a semiconductor switch 51 based on the timing signal SW thereby to switch over to a state, in which the limiter function is performed by the Zener diode 40, and a state, in which the limiter function is prohibited.

However, since the semiconductor switch 51 is connected between the anode side of the Zener diode 40 and the high potential side of the primary coil 21, it is necessary to increase the base voltage of the semiconductor switch 51 to be higher than the potential (for example, battery voltage Vb=14V) of the high potential side by a predetermined voltage. It is thus necessitated to provide a power source 54, which supplies the predetermined voltage (for example, 5V). Since the timing signal SW is a 5V signal, it is also necessitated to provide a circuit, which controls the base voltage (14V+5V) of the semiconductor switch 51 based on the timing signal SW of low potential (5V).

Figure 3:
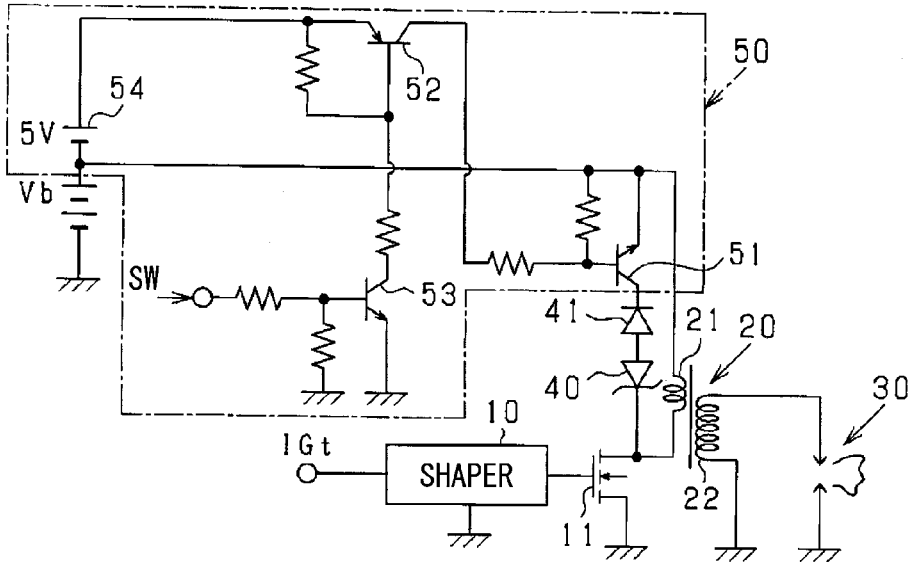
FIG. 3 is a circuit diagram showing a switching circuit according to the first embodiment.

Accordingly, in the example shown in FIG. 3, the battery voltage Vb (14V) is increased by an amount of the predetermined voltage (for example 5V) by the power source 54. The increased base voltage (14V+5V) is on/off-controlled by a semiconductor switch 52. The base voltage of the semiconductor switch 52 is controlled by a separate semiconductor switch 53, which is controlled based on the timing signal SW.

Figure 4:
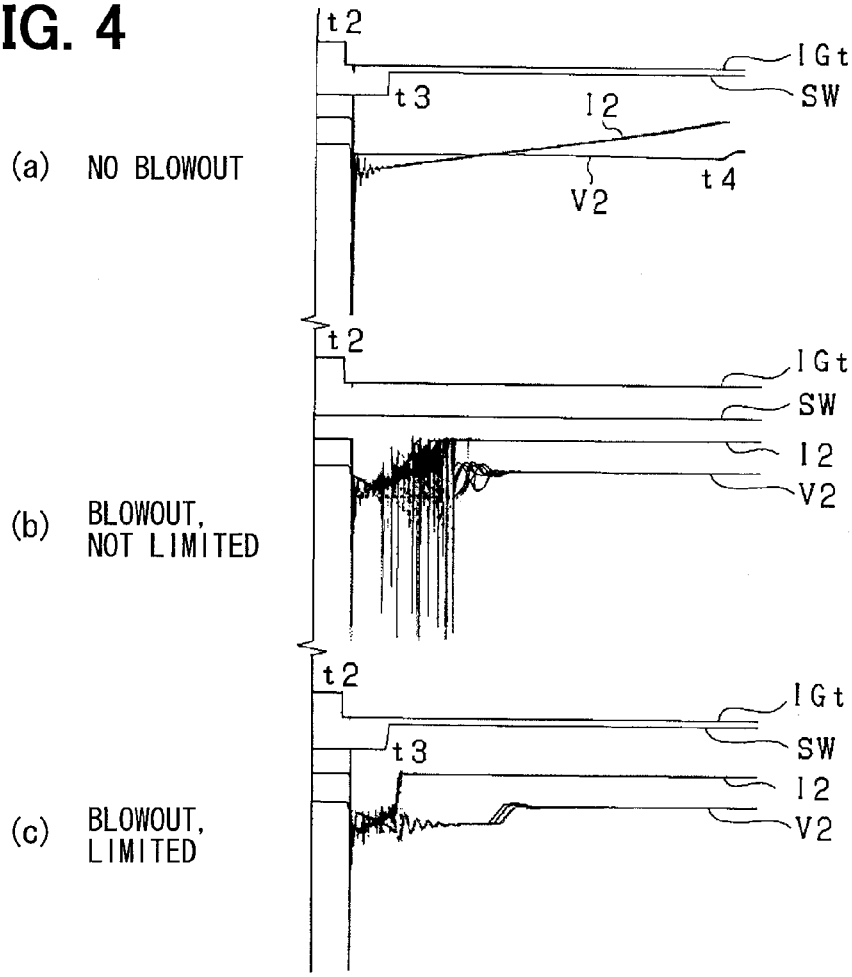
FIG. 4 is a time chart showing results of experimental tests conducted on the ignition apparatus according to the first embodiment.

FIG. 4 shows results of experimental tests. In FIG. 4, time charts (b) and (c) show changes in the ignition signal IGt, the timing signal SW, the secondary current I2 and the secondary voltage V2 measured in experimental tests, which is conducted by generating blowout conditions by blowing air streams to electric discharges. Here, time chart (b) shows an experimental result in a case that the limiter function of the Zener diode 40 is persistently prohibited without switching the timing signal SW to ON. On the other hand, time chart (c) shows an experimental result in a case that the limiter function is started at time t3 in the same manner as (f) of FIG. 2. Time chart (c) of FIG. 4 corresponds to (e') of FIG. 2. Time chart (a) of FIG. 4 shows experimental results in a case that, although the limiter function is started at time t3, no air stream is blown and no blowout is caused. This time chart (a) of FIG. 4 corresponds to (d) and (e) of FIG. 2.

From the experimental result shown in (a), in which the limiter function is started at time t3, it is confirmed that the discharge continues normally until time t4 unless the blowout is caused. According to the experimental result shown in (b), it is confirmed that the secondary voltage V2 and the secondary current I2 rise and fall remarkably in a midst of the inductive discharge period. This indicates that the repetition of blowout and redischarge is caused unless the limiter function is performed. According to the experimental result shown in (c), it is confirmed that the repetition of remarkable rise and fall of the secondary voltage V2 and the secondary current I2 is more reduced by the limiter function in comparison to the case shown in (b). This indicates that the redischarge following the blowout is avoided by the limiter function.

As described above, according to the first embodiment, the primary voltage V1 is limited to the primary limit value V1ZD or less during the predetermined time period Tb after the discharge is started. As a result, the secondary voltage V2 is limited to the secondary limit value V2*th* or more (absolute value of V2 is limited to the absolute value of the secondary limit value V2*th* or less). Thus it is prevented that the discharge occurs again immediately after the blowout. The plug exhaustion can be suppressed by avoiding the repetition of discharges.

Further, the primary limit value V1ZD is set so that the secondary limit value V2*th* becomes smaller (larger absolute value) than the maintaining voltage Vcon. As a result, when no blowout is caused, the inductive discharge is maintained as usual. It can be avoided that the inductive discharge period t3 to t4 is shortened even when no blowout is generated, and further that the misfire is caused by the insufficiency of the inductive discharge period t3 to t4. Since the limiter function is prohibited at the time of start of the discharge, it can be avoided that the misfire is caused by the limitation of the secondary voltage in the period t2 to t3, in which the secondary voltage rises.

According to the first embodiment, as described above, it is possible to suppress the plug exhaustion by avoiding occurrence of repetition of the redischarge and to prevent misfire caused by the insufficiency of the discharge period.

Second Embodiment

Figure 5:
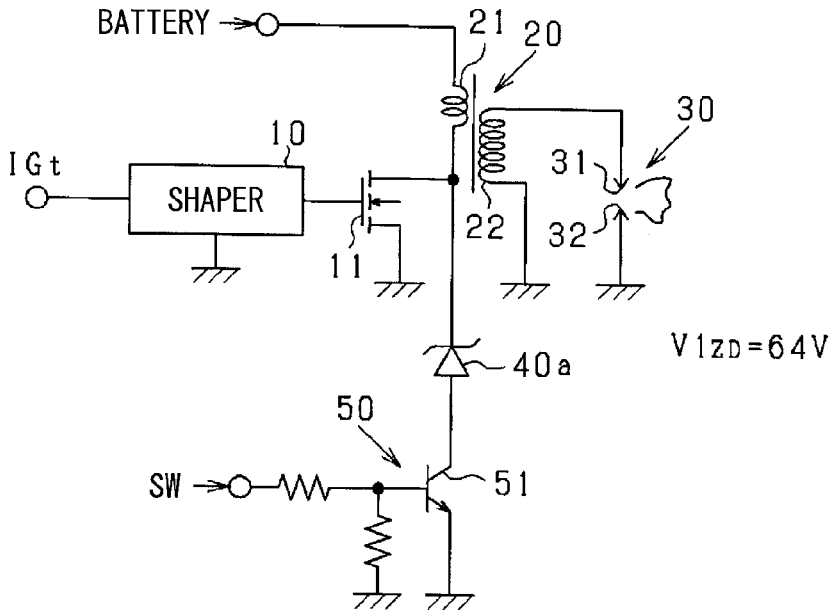
FIG. 5 is a schematic diagram of an ignition apparatus according to a second embodiment.

Although the semiconductor switch 51 is connected between the anode side of the Zener diode 40 and the high potential side of the primary coil 21 in the first embodiment as shown in FIGS. 1 and 3, the semiconductor switch 51 is connected between the anode side of a Zener diode 40*a* and the ground in a second embodiment shown in FIG. 5.

As a result, it is unnecessary to increase the base voltage of the semiconductor switch 51 to be higher than the high potential side voltage of the primary coil 21, and hence the power source 54 necessitated in the first embodiment need not be provided. Since the timing signal SW of 5V itself can be used as the base voltage of the semiconductor switch 51, the semiconductor switches 52 and 53 necessitated in the first embodiment need not be provided.

According to the second embodiment, since the semiconductor switches 52, 53 and the power source 54 are eliminated, the configuration of the switch circuit 50 can be simplified.

Here, in a case that the switch circuit 50 is configured as shown in FIG. 3 and the turn ratio between the primary coil 21 and the secondary coil 22 of the ignition coil 20 is 80, the Zener voltage V1ZD may be set to 50V to attain the secondary limitation value V2*th* of 4 kV (50V=4 kV/80). In a case of the switch circuit 50 according to the second embodiment shown in FIG. 5, the Zener voltage V1ZD may be set to a value, which is 50V plus the battery voltage 14V, to attain the secondary limitation value V2*th* of 4 kV.

Third Embodiment

Figure 6:
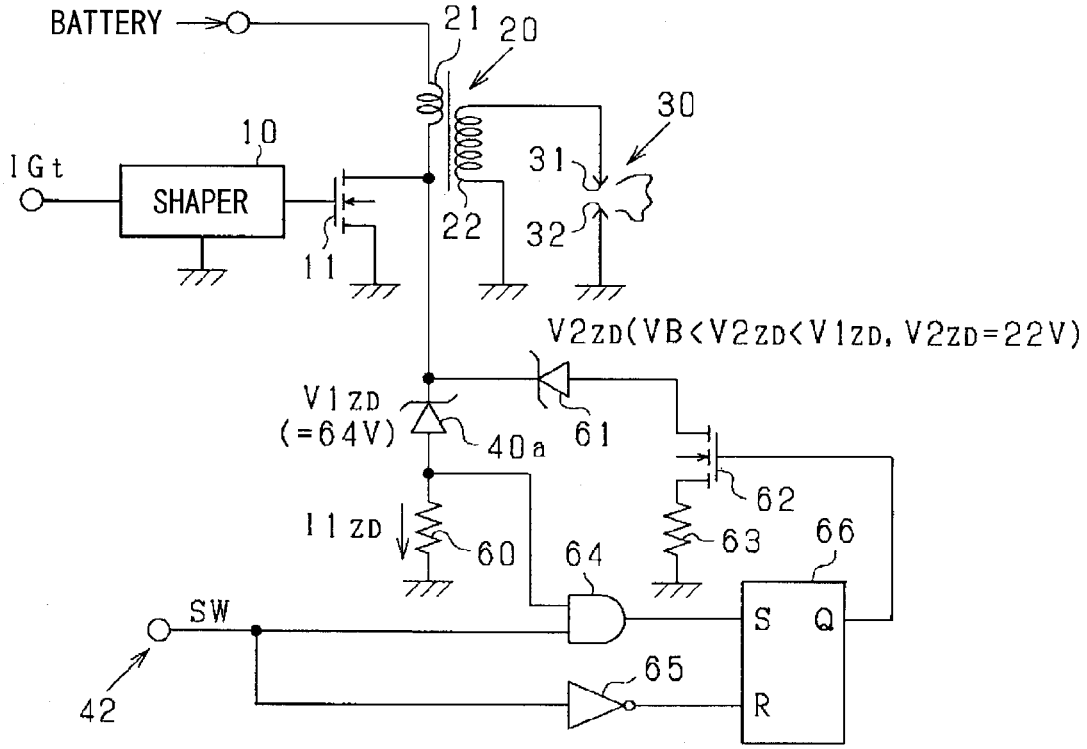
FIG. 6 is a schematic diagram of an ignition apparatus according to a third embodiment.

According to a third embodiment, which is a variation of the second embodiment, another path for discharging discharge energy is further provided to surely discharge the discharge energy stored in the ignition coil 20 when the discharge blowout arises once. As shown in FIG. 6, this path is separate from the path starting from the primary coil 21 to the ground through the Zener diode 40*a*. The Zener diode 40*a* is referred to as a first Zener diode and the power device 11 is referred to as a first power device.

As shown in the figure, the anode side of the first Zener diode 40*a* is grounded through a first resistor 60. The cathode side of the first Zener diode 40*a* is connected to the cathode side of a second Zener diode 61. An anode side of the second Zener diode 61 is grounded through a second power device (N-channel MOSFET) 62 and a second resistor 63. The second Zener diode 62 is provided to prevent a current from flowing from the battery to the ground through the second power device 62 when the second power device 62 is turned on. Specifically, a Zener voltage V2ZD of the second Zener diode 62 is set to a voltage (for example, 22 V), which is higher than a terminal voltage VB (for example, 14 V) of the battery and lower than the Zener voltage V1ZD of the first Zener diode 40*a*. The first Zener diode 40*a* and the first resistor 60 form a detection circuit.

A junction between the first Zener diode 40*a* and the first resistor 60 and an output side of the timing generator circuit 42, which generates the switching signal SW, are connected to input terminals of an AND circuit 64. An output side of the timing generator circuit 42 is connected also to an input terminal of a NOT circuit 65.

An output terminal of the AND circuit 64 is connected to a set terminal (S-terminal) of a RS flip-flop 66 and an output terminal of the NOT circuit 65 is connected to a reset terminal (R-terminal) of the RS flip-flop 66. An output terminal (Q-terminal) of the RS flip-flop 66 is connected to a gate of the second power device 62. The timing generator circuit 42, the second power device 62, the AND circuit 64, the NOT circuit 65 and the RS flip-flop 66 form a switching circuit.

Figure 7:
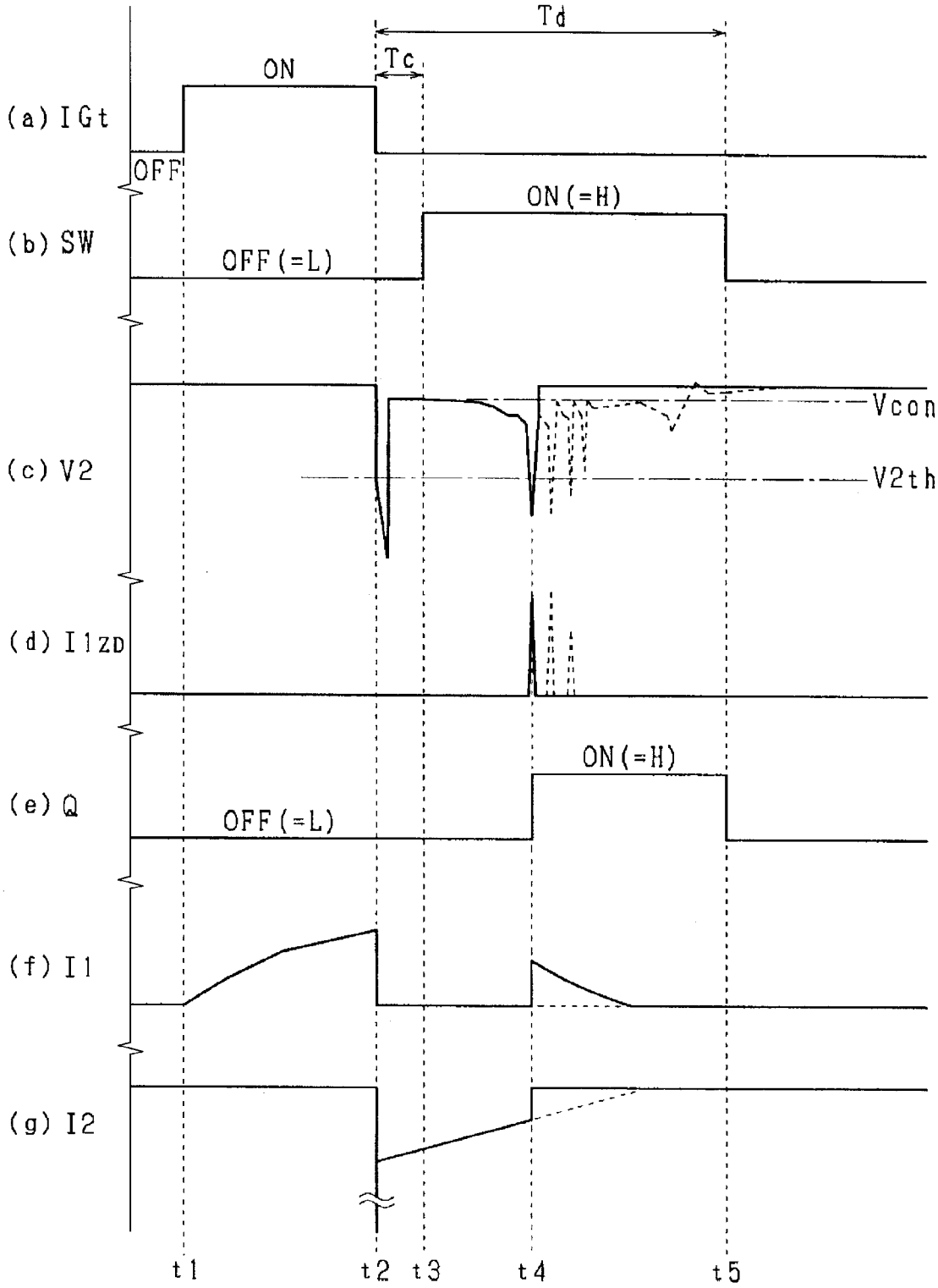
FIG. 7 is a time chart showing an operation of the ignition apparatus according to the third embodiment.

A method of preventing a repetition of discharge will be described with reference to a time chart shown in FIG. 7. Specifically, in FIG. 7, (*a*), (*b*) (*c*) and (*d*) respectively show changes of the ignition signal IGt, the timing signal SW, the secondary voltage V2 and the current I1ZD, which flows in the first resistor 60. Further in FIG. 7, (*e*), (*f*) and (*g*) respectively show changes of an output signal at the Q terminal of the RS flip-flop 66, the primary current I1 and the secondary current I2.

As shown by a solid line in the figure, the primary current I1 starts to increase at time t1 when the ignition signal IGt is switched to ON. Then, when the ignition signal IGt is switched to OFF at time t2, the secondary voltage V2 rises to cause discharge between the electrodes 31 and 32 of the spark plug 30 and the secondary current I2 starts to flow.

At time t3, which is after an elapse of a first predetermined time period Tc from time t2, a logic level of the timing signal SW is inverted from L (low level) to H (high level). When the discharge blowout arises at time t4, the secondary voltage V2 rises again and the primary voltage V1 rises. As a result, the primary voltage V1 reaches the Zener voltage V1ZD of the first Zener diode 40*a* and the current I1ZD flows in the first resistor 60.

Thus the voltage at the junction between the first resistor 60 and the first Zener diode 40*a* rises and the logic level of the output signal of the AND circuit 64 is inverted to H. Since the logic level of the output signal of the Q terminal of the RS flip-flop 66 is inverted, the second power device 62 is turned on. As a result, a closed loop is formed by the primary coil 21, the second Zener diode 61, the second power device 62 and the second resistor 63. The primary current I1 flows in the closed circuit. At time t5, which is after an elapse of a second predetermined time period Td from time t2, the logic level of the timing signal SW is inverted to L and the logic level of the output signal of the Q terminal is inverted to L. The second power device 62 is thus turned off.

According to the above-described configuration, the second power device 62 can be turned on so that the ground side of the primary coil 21 and the ground are forcibly connected for the predetermined time period (time t4 to time t5) after a detection that the absolute value of the primary voltage V1 has reached the Zener voltage V1ZD of the first Zener diode 40*a*. For this reason, the secondary current I2 is prevented from flowing after time t4 and hence plug exhaustion caused by the secondary current I2 can be suppressed.

According to the second embodiment described above, as indicated by a broken line in FIG. 7, it is likely that the secondary current I2 is not prevented from flowing after time t4, at which the discharge blowout arises. Since the discharge path for the discharge energy stored in the ignition coil 20 is formed only when the primary voltage V1 reaches the Zener voltage V1ZD of the Zener diode 40*a*, the discharge energy stored in the ignition coil 20 cannot be discharged properly when the primary voltage V1 falls thereafter.

In the third embodiment, it is confirmed that the combustion condition of the engine is not adversely affected even when the secondary current I2 is interrupted after time t4. This is explained as follows.

The repetition of discharge is caused when the air stream F in the cylinder is strong. In this condition, state of mixture formation becomes suitable for combustion so that the mixture is ignited properly. For this reason, once the mixture is ignited after the ignition signal IGt is switched to OFF for discharge of electric energy, the combustion is not adversely affected even when the discharge blowout arises thereafter.

It is thus possible to surely interrupt the flow of the secondary current immediately after an occurrence of the discharge blowout. Thus the plug is protected from exhaustion.

Other Embodiments

The ignition apparatus is not limited to the above-described embodiments but may be implemented with the following alterations. It may also be implemented by combining arbitrarily characteristic configurations of the embodiments.

In each of the embodiments described above, the limiter function is started after the elapse of the predetermined time period Ta from time t2, at which the ignition signal IGt is changed to OFF, and the predetermined time period Ta is fixed to a predetermined value. The predetermined time period Ta may however be set variably in accordance with the operating conditions of the internal combustion engine.

For example, in a case of an operating condition, in which the possibility of misfire is low, it is preferred to surely avoid the repetition of discharging by setting the predetermined time period Ta to be short. Further, in a case of an operating condition, in which the possibility of the repetition of discharging is low, it is preferred to set the predetermined time period Ta to be long.

Although the diode 41 is provided at the anode side of the Zener diode 40 in the first embodiment, it may be eliminated.

In a case that the diode 41 is provided, it is possible to prevent a current from flowing from the anode side to the cathode side of the Zener diode 40 even when the power device 11 is erroneously turned on during the predetermined time period Tb, in which the switch circuit 50 is being turned on. It is also possible to prevent the current from flowing from the anode side to the cathode side of the Zener diode 40 even when the switch circuit 50 is erroneously turned on in the charging period t1 to t2, in which the power device 11 is turned on.

In the embodiments described above, the Zener diodes 40 and 40*a* are provided to form the constant voltage circuit (limiter device), which limits the primary voltage V1 to be equal to or lower than the primary limitation value V1ZD. The ignition apparatus is not limited to the circuit configurations shown in FIGS. 3 and 5, which include the Zener diodes 40 and 40*a*.

In the embodiments described above, the present disclosure is applied to the ignition apparatus, in which the center electrode 31 is provided as the negative electrode and the ground electrode 32 is provided as the positive electrode to perform the discharging (negative discharging). The present disclosure may be applied to an ignition apparatus, in which the center electrode 31 is provided as the positive and the ground electrode 32 is provided as the negative electrode to perform the discharging (positive discharging).

Although the low potential side of the secondary coil 22 is grounded in the embodiments described above, the low potential side of the secondary coil 22 may be connected to the positive terminal of the battery.

The detection circuit is not limited to the example of the third embodiment. For example, it may be formed of the ECU 5 and a circuit, which divides a voltage developed at a junction between the first Zener diode 40*a* and the first resistor 60 and applies the divided voltage to the ECU 5. In this case, when the ECU 5 detects that the divided voltage of the voltage developed at the junction exceeds a predetermined voltage, the second power device 62 may be turned on by the ECU 5. In this case, the ECU 5 performs a function of the switching circuit.

What is claimed is:

1. An ignition apparatus for an internal combustion engine comprising:

a spark plug;

an ignition coil having a primary coil and a secondary coil for supplying the spark plug with a secondary voltage generated by the secondary coil for a discharge operation of the spark plug in correspondence to a change in a primary voltage of the primary coil;

a limiter device for limiting, as a limiter function, the primary voltage to be equal to or less than a predetermined value in absolute value; and a switching device for prohibiting the limiter function of the limiter device at a start of discharge of the spark plug and switching the limiter device to perform the limiter function for a predetermined time period after the start of discharge operation of the spark plug.

2. The ignition apparatus according to claim 1, wherein:

the limiter device is a voltage regulator circuit, which includes a Zener diode connected to the primary coil and limits the primary voltage to be equal to or less than a Zener voltage.

3. The ignition apparatus according to claim 2, wherein:

the Zener diode has a cathode side connected to a ground side of the primary coil and an anode side connected to a ground side; and the switching device is a switching circuit including a semiconductor switch, which turns on and off a connection between the anode side of the Zener diode and the ground.

4. The ignition apparatus according to claim 2, further comprising:

a detection circuit connected to the Zener diode for detecting that an absolute value of the primary voltage has reached the Zener voltage of the Zener diode, which has a cathode side and an anode side connected to a ground side of the primary coil and a ground, respectively, wherein the switching device includes a semiconductor switch for turning on and off a connection between the ground side of the primary coil and the ground, and wherein the semiconductor switch connects the ground side of the primary coil and the ground forcibly for a predetermined period only after the detection circuit detects that the absolute value of the primary voltage has reached the Zener voltage.

5. The ignition apparatus according to claim 4, wherein:

the Zener diode connected to the detection circuit is provided as a first Zener diode;

the switching device further includes a second Zener diode connected in series with the semiconductor switch and in parallel to the first Zener diode, the second Zener diode having a second predetermined Zener voltage higher than a voltage of a battery supplied to the primary coil and lower than a first Zener voltage of the first Zener diode.

6. The ignition apparatus according to claim 2, wherein:

the Zener voltage is set so that the secondary voltage of the secondary coil is limited in a predetermined range between a predetermined limit value, which prevents redischarge after blowout of the discharge, and a maintaining voltage value, which is required to maintain an inductive discharge of the spark plug.

7. The ignition apparatus according to claim 1, wherein:

the switching device switches over the limiter device to perform the limiter function after an elapse of a predetermined time period from generating a command of power supply control for the primary coil for starting the discharge of the spark plug.

8. The ignition apparatus according to claim 7, wherein:

the predetermined time period is variable with an operating state of the internal combustion engine.

9. The ignition apparatus according to claim 1, further comprising:

a power device connected in series with the primary coil to turn on and off current supply to the primary coil in response to an ignition signal determined in correspondence to an operating condition of the engine.

10. The ignition apparatus according to claim 9, wherein:

the switching device is turned on only after the power device is turned off.

* * * * *